US012516521B2

(12) United States Patent
Li et al.

(10) Patent No.: US 12,516,521 B2
(45) Date of Patent: Jan. 6, 2026

(54) WALLBOARD WITH SELF-LOCKING FUNCTION AND PRE-EXPANSION SPACE

(71) Applicant: Jiangsu Ousheng New Materials Co., Ltd., Zhenjiang (CN)

(72) Inventors: Haixing Li, Zhenjiang (CN); Jianhong Xu, Zhenjiang (CN); Junhua Zhang, Zhenjiang (CN)

(73) Assignee: Jiangsu Ousheng New Materials Co., Ltd., Zhenjiang (CN)

( * ) Notice: Subject to any disclaimer, the term of this patent is extended or adjusted under 35 U.S.C. 154(b) by 230 days.

(21) Appl. No.: 18/390,790

(22) Filed: Dec. 20, 2023

(65) Prior Publication Data

US 2025/0207388 A1 Jun. 26, 2025

(51) Int. Cl.
*E04B 2/82* (2006.01)

(52) U.S. Cl.
CPC ..... *E04B 2/828* (2013.01)

(58) Field of Classification Search
CPC ..... E04B 2/828; E04B 2/82
See application file for complete search history.

(56) References Cited

U.S. PATENT DOCUMENTS 5,524,402 A * 6/1996 Sykes ..... E04B 2/82 52/241
6,351,915 B1 * 3/2002 Puckett ..... E04B 2/96 52/235

FOREIGN PATENT DOCUMENTS

| | | |
|---|---|---|
| CN | 109435049 A | 3/2019 |
| CN | 110900852 A | 3/2020 |
| CN | 116117964 A | 5/2023 |

* cited by examiner

*Primary Examiner* — Rodney Mintz
(74) *Attorney, Agent, or Firm* — Nitin Kaushik

(57) ABSTRACT

The present disclosure relates to a wallboard with a self-locking function and a pre-expansion space. A left edge, a right edge, a front edge, or a rear edge is provided with a first strip-shaped groove along the edge; a corresponding edge parallel to the edge provided with the first strip-shaped groove is provided with a strip-shaped bulge; a step is arranged on an outermost side of a lower part of the first strip-shaped groove; an insertion strip is arranged on the step; a strip-shaped clamping groove matched with the insertion strip is provided at a lower part of the strip-shaped bulge; an upper part of the strip-shaped bulge is a vertical surface; a second strip-shaped groove is provided in a position, adjacent to an inclined surface, of a lower board surface; and two side edges of the second strip-shaped groove are both provided with inclined structures.

8 Claims, 6 Drawing Sheets

WALLBOARD WITH SELF-LOCKING FUNCTION AND PRE-EXPANSION SPACE

TECHNICAL FIELD

The present disclosure relates to the technical fields of wallboards, and specifically to a wallboard with a self-locking function and a pre-expansion space.

BACKGROUND

Wallboards refer to house structures for a load-bearing system composed of walls and floor slabs. Walls are used as both load-bearing components and room partitions, which are in the most commonly used and economical structural form in residential buildings. In order to overcome the disadvantage of poor flexibility of room layout, it is developing towards large bays.

Wallboard structures are mostly used in residential buildings, apartments, office buildings, schools, and other public buildings.

When existing large flat plate type wallboards are mounted, a gap needs to be directly reserved between the wallboards. The gap is a reserved space for subsequent wallboard expansion. However, in the prior art, this gap completely needs to be judged by constructors themselves, so the gap is varying, and when some constructors with insufficient experiences reserve a small gap, a bulge is easily formed at a joint during subsequent wallboard expansion to cause unqualified construction.

SUMMARY

An objective of the present disclosure is to provide a wallboard with a self-locking function and a pre-expansion space, which overcomes the deficiencies in the prior art, solves the technical problem that a direct gap between wallboards during construction is uncontrollable and relies entirely on experiences of a constructor in the prior art, and effectively avoids the problem of a raised joint caused by an excessively small gap or an aesthetic impact caused by an excessively large gap.

To solve the above problems, the present disclosure adopts the following technical solution:

A wallboard with a self-locking function and a pre-expansion space includes an upper board surface, a lower board surface, a left edge, a right edge, a front edge, and a rear edge, where the upper board surface and the lower board surface are parallel to each other; the left edge and the right edge are parallel to each other; the front edge and the rear edge are parallel to each other; the left edge, the right edge, the front edge, or the rear edge is provided with a first strip-shaped groove along the edge; the corresponding edge parallel to the edge provided with the first strip-shaped groove is provided with a strip-shaped bulge; a self-locking structure matched is arranged on the strip-shaped bulge and the first strip-shaped groove; a lower part of the strip-shaped bulge is an inclined surface, and an angle between the inclined surface and a lower surface of the strip-shaped bulge is an acute angle; an upper part of the strip-shaped bulge is a vertical surface; a second strip-shaped groove is provided in a position, adjacent to the inclined surface, of the lower board surface; two side edges of the second strip-shaped groove are both provided with inclined structures and have the same inclination angle as the inclined surface; a width between a bottommost position of the inclined surface and an outermost side of the strip-shaped bulge is less than a depth of the first strip-shaped groove; a width between the vertical surface and the outermost side of the strip-shaped bulge is greater than the width between the bottommost position of the inclined surface and the outermost side of the strip-shaped bulge; and a thickness of the strip-shaped bulge in an up-down direction is less than a width of the first strip-shaped groove in the up-down direction.

Further, the self-locking structure includes a bulge located on an upper side or a lower side of the first strip-shaped groove and a recess located on the strip-shaped bulge and matched with the bulge.

Further, the self-locking structure is a spring type insertion strip; a step is arranged on an outermost side of a lower part of the first strip-shaped groove; the insertion strip is arranged on the step and is fixed to the step by a plurality of springs; an upper part of the insertion strip protrudes into the first strip-shaped groove in a natural state of the springs; and a strip-shaped clamping groove matched with the insertion strip is provided in the lower part of the strip-shaped bulge.

Further, a plurality of guide and limit columns are arranged on the step and are in a one-to-one correspondence with the plurality of springs; a plurality of guide holes in a one-to-one correspondence with the guide and limit columns are pmvided in the insertion strip and sleeved on the guide and limit columns; the springs are sleeved on the guide and limit columns and located between the insertion strip and the step; and the springs have lower parts fixedly connected to the step and upper parts fixedly connected to the insertion strip.

Further, the vertical surface is provided with a third strip-shaped groove in a connecting position of an upper surface of the strip-shaped bulge.

Further, a cross section of the third strip-shaped groove is of a trapezoidal structure.

Further, the angle between the inclined surface and the lower surface of the strip-shaped bulge is 70-80°.

Further, a distance between the upper surface of the strip-shaped bulge and the upper board surface is greater than a distance between an upper surface of the first strip-shaped groove and the upper board surface.

Further, a distance between the lower surface of the strip-shaped bulge and the lower board surface is greater than a distance between a lower surface of the first strip-shaped groove and the lower board surface.

Further, the angle between the inclined surface and the lower surface of the strip-shaped bulge is 75°.

Further, the edges, provided with the first strip-shaped groove and the strip-shaped bulge, of the upper board surface are both provided with chamfer structures.

In a method for mounting the wallboard with a self-locking function and a pre-expansion space, when two wallboards are mounted, a strip-shaped bulge of one wallboard is correspondingly inserted into a first strip-shaped groove of the other wallboard, and a bottommost position of an inclined surface is pushed to an outer side of the first strip-shaped groove, such that upper surfaces of the two wallboards are flush and edges are aligned.

Compared with the prior art, the present disclosure has the following beneficial effects:

According to the wallboard with a self-locking function and a pre-expansion space provided by the present disclosure, lock catches on two sides of the wallboard adopt a three-layer structure; when two wallboards are mounted, the three-layer structures are all provided with gaps; when the wallboard is damp, a wallboard body and a middle layer will expand to fill the gap, making it firmer; during expansion, an inclined surface of a third layer will be squeezed towards the second strip-shaped groove or even broken, and broken wood chips are filled inside the second strip-shaped groove, which can effectively ensure that a joint between the wallboards is not raised; in a first layer, the width between the vertical surface and the outermost side of the strip-shaped bulge is greater than the width between the bottommost position of the inclined surface and the outermost side of the strip-shaped bulge, such that during mounting of the wallboards, a gap between the wallboards can be optimized as much as possible when the bottommost position of the inclined surface is pushed to the other wallboard; moreover, the insertion strip and the strip-shaped clamping groove are added, and the insertion strip is clamped in the strip-shaped clamping groove, making the joint firm to connect and difficult to loosen.

DESCRIPTION OF THE EMBODIMENTS

Figure 1:
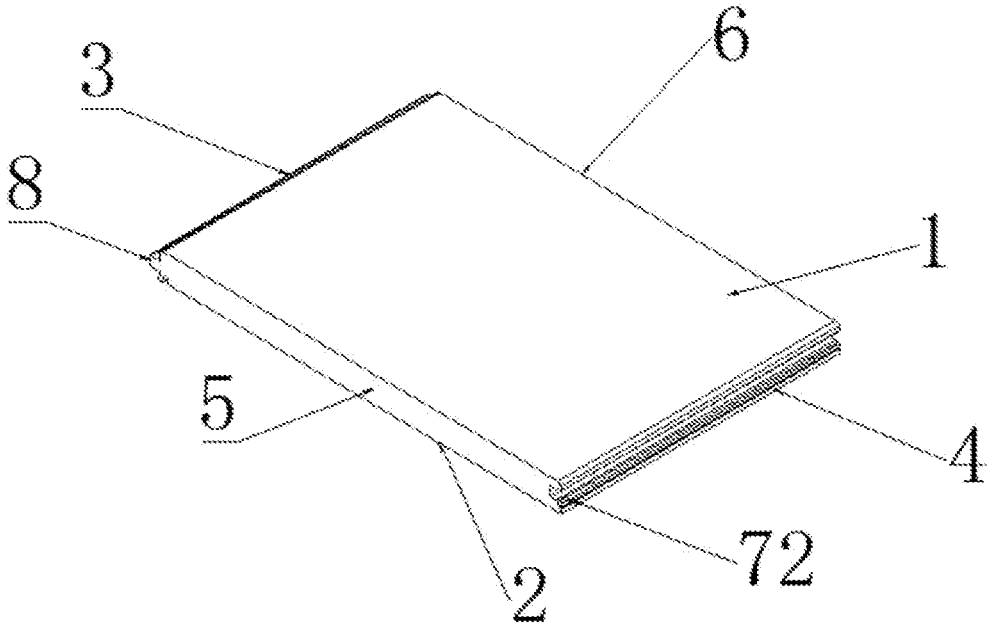
FIG. 1 is a schematic structural diagram of a wallboard with a self-locking function and a pre-expansion space.
Figure 2:
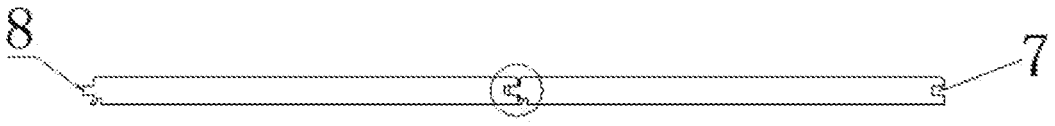
FIG. 2 is a schematic structural diagram of two wallboards in a mounted state.
Figure 3:
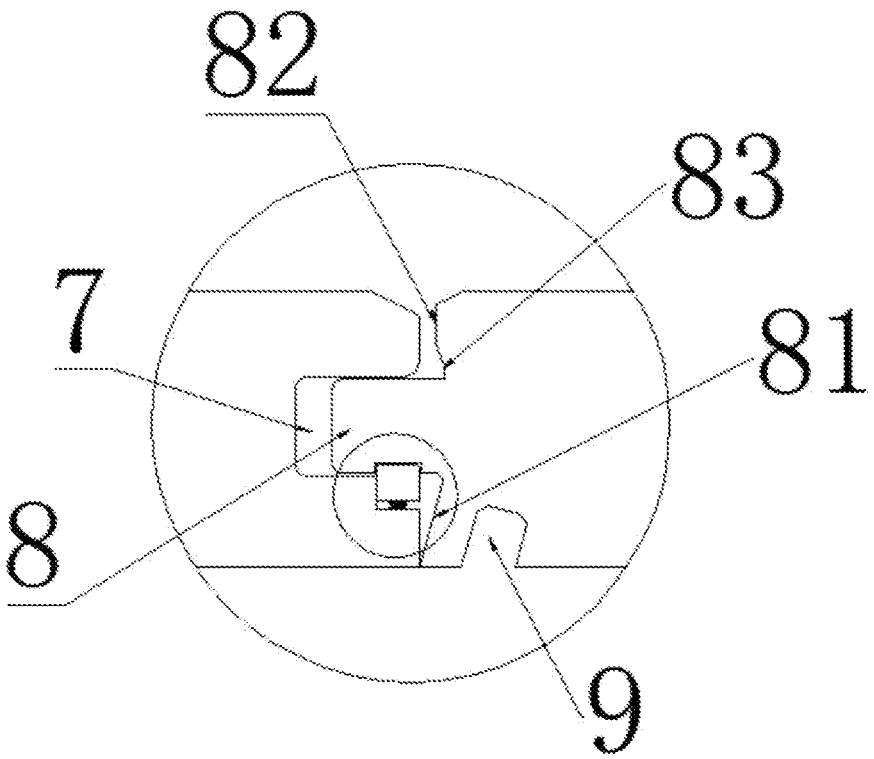
FIG. 3 is a first schematic diagram of a partially enlarged structure of two wallboards in a mounted state.
Figure 4:
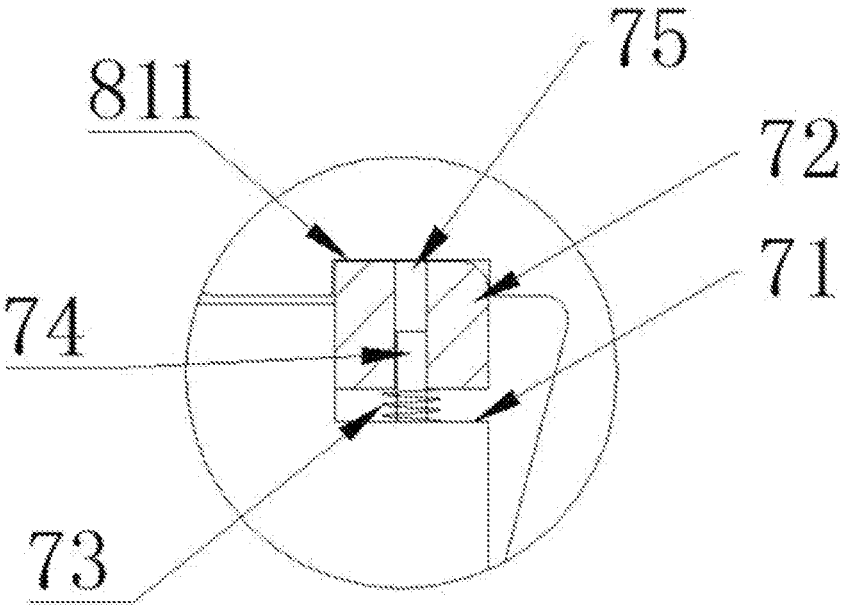
FIG. 4 is a schematic diagram of the partially enlarged structure in FIG. 3.

The technical solutions in the embodiments of the present disclosure will be clearly and completely described below in conjunction with the accompanying drawings in the embodiments of the present disclosure. Apparently, the described embodiments are merely some rather than all of the embodiments of the present disclosure. All other embodiments obtained by those of ordinary skill in the art based on the embodiments of the present disclosure without creative efforts shall fall within the scope of protection of the present disclosure.

Embodiment 1

As shown in FIGS. 1, 2, 3, and 4, a wallboard with a self-locking function and a pre-expansion space according to the present disclosure includes an upper board surface 1, a lower board surface 2, a left edge 3, a right edge 4, a front edge 5, and a rear edge 6, where the upper board surface 1 and the lower board surface 2 are parallel to each other; the left edge 3 and the right edge 4 are parallel to each other; the front edge 5 and the rear edge 6 are parallel to each other; the left edge 3, the right edge 4, the front edge 5, or the rear edge 6 is provided with a first strip-shaped groove 7 along the edge; the corresponding edge parallel to the edge provided with the first strip-shaped groove 7 is provided with a strip-shaped bulge 8; a self-locking structure matched is arranged on the strip-shaped bulge and the first strip-shaped groove; the self-locking structure is a spring type insertion strip; a step 71 is arranged on an outermost side of a lower part of the first strip-shaped groove 7; the insertion strip 72 is arranged on the step 71 and is fixed to the step 71 by a plurality of springs 73; an upper part of the insertion strip 72 protrudes into the first strip-shaped groove in a natural state of the springs; a strip-shaped clamping groove 811 matched with the insertion strip is provided in a lower part of the strip-shaped bulge; the lower part of the strip-shaped bulge is an inclined surface 81, and an angle between the inclined surface 81 and a lower surface of the strip-shaped bulge is an acute angle; an upper part of the strip-shaped bulge is a vertical surface 82; a second strip-shaped groove 9 is provided in a position, adjacent to the inclined surface 81, of the lower board surface 2; two side edges of the second strip-shaped groove 9 are both provided with inclined structures and have the same inclination angle as the inclined surface 81; a width between a bottommost position of the inclined surface 81 and an outermost side of the strip-shaped bulge 8 is less than a depth of the first strip-shaped groove 7; a width between the vertical surface 82 and the outermost side of the strip-shaped bulge 8 is greater than the width between the bottommost position of the inclined surface 81 and the outermost side of the strip-shaped bulge 8; and a thickness of the strip-shaped bulge 8 in an up-down direction is less than a width of the first strip-shaped groove 7 in the up-down direction.

Further, the vertical surface 82 is provided with a third strip-shaped groove 83 in a connecting position of an upper surface of the strip-shaped bulge 8; and a cross section of the third strip-shaped groove is of a trapezoidal structure.

Further, the angle between the inclined surface and the lower surface of the strip-shaped bulge is 70-80°.

Lock catches on two sides of the wallboard adopt a three-layer structure.

In a first layer, the width between the vertical surface 82 and the outermost side of the strip-shaped bulge 8 is greater than the width between the bottommost position of the inclined surface 81 and the outermost side of the strip-shaped bulge 8, such that during mounting of wallboards, a gap between the wallboards can be optimized as much as possible when the bottommost position of the inclined surface 81 is pushed to the other wallboard.

In a second layer, the width between the bottommost position of the inclined surface 81 and the outermost side of the strip-shaped bulge 8 is less than the depth of the first strip-shaped groove 7, such that there is a specific gap between the strip-shaped bulge and a bottom of the first strip-shaped groove when the bottommost position of the inclined surface 81 is pushed to the other wallboard.

In a third layer, the second strip-shaped groove is provided in the position, adjacent to the inclined surface 81, of the lower board surface 2, such that there is equivalently a strip-shaped inclined strip at the position.

When the wallboard is damp, a wallboard body and a middle layer will expand to fill the gap, making it firmer; and during expansion, an inclined surface of a third layer will be squeezed towards the second strip-shaped groove or even broken, and broken wood chips are filled inside the second strip-shaped groove, which can effectively ensure that the wallboards are not raised.

Embodiment 2

A plurality of guide and limit columns 74 are arranged on the step and are in a one-to-one correspondence with the plurality of springs 73; a plurality of guide holes 75 in a one-to-one correspondence with the guide and limit columns 74 are provided in the insertion strip 72 and sleeved on the guide and limit columns 74; the springs 73 are sleeved on the guide and limit columns 74 and located between the insertion strip 72 and the step 71; and the springs have lower parts fixedly connected to the step and upper parts fixedly connected to the insertion strip.

Embodiment 3

As shown in figure, preferably, a distance between the upper surface of the strip-shaped bulge and the upper board surface is greater than a distance between an upper surface of the first strip-shaped groove and the upper board surface. A distance between the lower surface of the strip-shaped bulge and the lower board surface is greater than a distance between a lower surface of the first strip-shaped groove and the lower board surface. Further, the angle between the inclined surface and the lower surface of the strip-shaped bulge is 75°. The edges, provided with the first strip-shaped groove and the strip-shaped bulge, of the upper board surface are both provided with chamfer structures. There are gaps between three surfaces of an outer side of the strip-shaped bulge and three surfaces of an inner side of the first strip-shaped groove when the wallboard surfaces are flush, reserving an expansion space for subsequent expansion.

Embodiment 4

Figure 5:
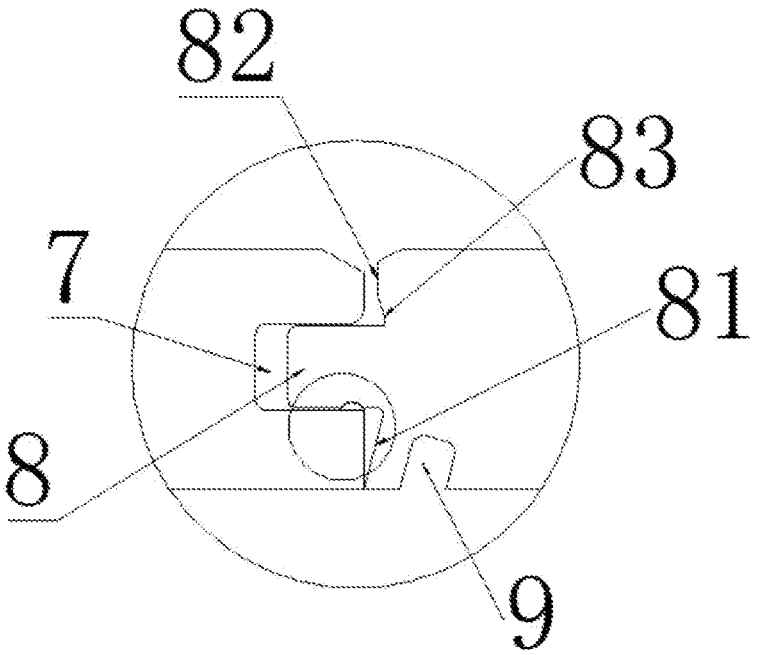
FIG. 5 is a second schematic diagram of a partially enlarged structure of two wallboards in a mounted state.
Figure 6:
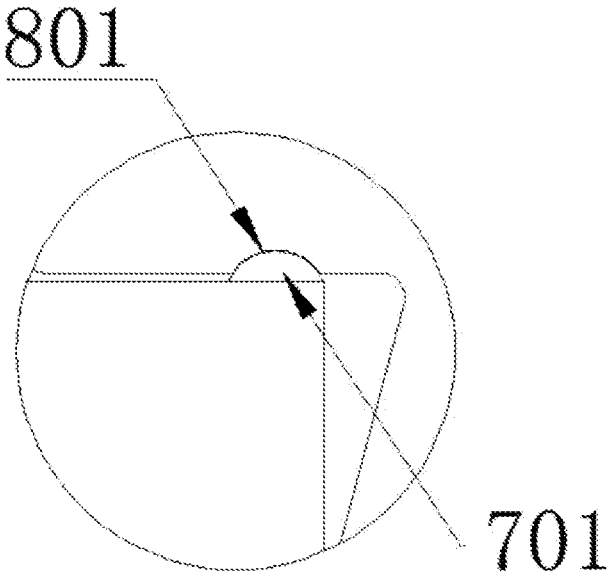
FIG. 6 is a schematic diagram of the partially enlarged structure in FIG. 5.

As shown in FIG. 5 and FIG. 6, the self-locking structure may also include a bulge and a recess located on the strip-shaped bulge and matched with the bulge. Such self-locking structure has the advantage of relatively low cost and the disadvantage of relatively poor self-locking stability.

In a method for mounting the wallboard, when two wallboards are mounted, a strip-shaped bulge of one wallboard is correspondingly inserted into a first strip-shaped groove of the other wallboard, an insertion strip moves down under the action of the strip-shaped bulge, moves up under the action of springs after reaching a strip-shaped clamping groove of the strip-shaped bulge, and is clamped in the strip-shaped clamping groove, and a bottommost position of an inclined surface is pushed to an outer side of the first strip-shaped groove, such that upper surfaces of the two wallboards are flush and edges are aligned.

The working principle is as follows: during mounting, a joint is firm to connect and difficult to loosen through matching between the insertion strip and the strip-shaped clamping groove; when the wallboard is damp, a wallboard body and a middle layer will expand to fill the gap, making it firmer; and during expansion, an inclined surface of a third layer will be squeezed towards the second strip-shaped groove or even broken, and broken wood chips are filled inside the second strip-shaped groove, which can effectively ensure that the wallboards are not raised.

It is obvious for those skilled in the art that the present disclosure is not limited to the details of the above exemplary embodiments and can be implemented in other specific forms without departing from the spirit or basic features of the present disclosure. Therefore, from any point of view, the embodiments should be regarded as exemplary and non-restrictive. The scope of the present disclosure is limited by the appended claims rather than the above description. Therefore, it is intended to include all changes falling within the meaning and scope of the same elements of the claims in the present disclosure. Any reference numerals in the claims shall not be regarded as limiting the claims involved.

What is claimed is:

1. A wallboard with a self-locking function and a pre-expansion space, comprising:

an upper board surface, a lower board surface, a left edge, a right edge, a front edge, and a rear edge, the upper board surface and the lower board surface being parallel to each other, the left edge and the right edge being parallel to each other, the front edge and the rear edge being parallel to each other, wherein the left edge, the right edge, the front edge, or the rear edge is provided with a first strip-shaped groove therealong; a corresponding edge parallel to the edge provided with the first strip-shaped groove is provided with a strip-shaped bulge; a self-locking structure matched with an insertion strip is positioned on the strip-shaped bulge and the first strip-shaped groove; a lower part of the strip-shaped bulge is an inclined surface, and an angle between the inclined surface and a lower surface of the strip-shaped bulge is an acute angle; an upper part of the strip-shaped bulge is a vertical surface; a second strip-shaped groove is provided in a position, adjacent to the inclined surface, of the lower board surface; two side edges of the second strip-shaped groove are both provided with inclined structures and have a same inclination angle as the inclined surface; a width between a bottommost position of the inclined surface and an outermost side of the strip-shaped bulge is less than a depth of the first strip-shaped groove; a width between the vertical surface and the outermost side of the strip-shaped bulge is greater than the width between the bottommost position of the inclined surface and the outermost side of the strip-shaped bulge; and a thickness of the strip-shaped bulge in an up-down direction is less than a width of the first strip-shaped groove in the up-down direction;

wherein a step is arranged on an outermost side of a lower part of the first strip-shaped groove; the insertion strip is arranged on the step and is fixed to the step by a plurality of springs; an upper part of the insertion strip protrudes into the first strip-shaped groove in a natural state of the springs; and a strip-shaped clamping groove matched with the insertion strip is provided in the lower part of the strip-shaped bulge;

wherein a plurality of guide and limit columns are located on the step and are in a one-to-one correspondence with the plurality of springs; a plurality of guide holes in a one-to-one correspondence with the guide and limit columns are located in the insertion strip and sleeved on the guide and limit columns; the springs are sleeved on the guide and limit columns and located between the insertion strip and the step; and the springs have lower parts fixedly connected to the step and upper parts fixedly connected to the insertion strip.

2. The wallboard according to claim 1, wherein the self-locking structure comprises a second bulge located on an upper side or a lower side of the first strip-shaped groove and a recess located on the strip-shaped bulge and matched with the second bulge.

3. The wallboard according to claim 1, wherein the angle between the inclined surface and the lower surface of the strip-shaped bulge is 70-80°.

4. The wallboard according to claim 1, wherein a distance between the upper surface of the strip-shaped bulge and the upper board surface is greater than a distance between an upper surface of the first strip-shaped groove and the upper board surface.

5. The wallboard according to claim 1, wherein a distance between the lower surface of the strip-shaped bulge and the lower board surface is greater than a distance between a lower surface of the first strip-shaped groove and the lower board surface.

6. The wallboard according to claim 1, wherein the angle between the inclined surface and the lower surface of the strip-shaped bulge is 75°.

7. The wallboard according to claim 1, wherein the vertical surface is provided with a third strip-shaped groove in a connecting position of an upper surface of the strip-shaped bulge.

8. The wallboard according to claim 7, wherein a cross section of the third strip-shaped groove is of a trapezoidal structure.

* * * * *